US007463233B2

(12) United States Patent
Kim

(10) Patent No.: US 7,463,233 B2
(45) Date of Patent: Dec. 9, 2008

(54) FERROELECTRIC LIQUID CRYSTAL DISPLAY AND METHOD OF DRIVING THE SAME

(75) Inventor: Hong Chul Kim, Ahnsan-shi (KR)

(73) Assignee: LG Display Co., Ltd., Seoul (KR)

( * ) Notice: Subject to any disclaimer, the term of this patent is extended or adjusted under 35 U.S.C. 154(b) by 139 days.

(21) Appl. No.: 10/603,763

(22) Filed: Jun. 26, 2003

(65) Prior Publication Data

US 2004/0085280 A1 May 6, 2004

(30) Foreign Application Priority Data

Oct. 30, 2002 (KR) ..... 10-2002-0066582

(51) Int. Cl.
*G09G 3/36* (2006.01)

(52) U.S. Cl. ..... 345/97; 345/87; 345/96; 345/99; 345/98

(58) Field of Classification Search ..... 345/87–104, 345/204–215; 349/78; 359/56
See application file for complete search history.

(56) References Cited

U.S. PATENT DOCUMENTS 4,789,899 A * 12/1988 Takahashi et al. ..... 348/793
4,923,285 A * 5/1990 Ogino et al. ..... 345/101
5,343,217 A * 8/1994 Kim ..... 345/95
5,539,546 A * 7/1996 Koden et al. ..... 349/86
5,646,755 A * 7/1997 Okada et al. ..... 345/97
5,900,852 A * 5/1999 Tanaka et al. ..... 345/87
5,959,598 A * 9/1999 McKnight ..... 345/90
6,037,920 A * 3/2000 Mizutome et al. ..... 345/87
6,040,814 A * 3/2000 Murakami et al. ..... 345/94
6,190,933 B1 * 2/2001 Shimabukuro et al. ..... 438/30
6,317,113 B1 * 11/2001 Wu ..... 345/92
6,340,960 B1 * 1/2002 Song et al. ..... 345/60
6,567,065 B1 * 5/2003 Kondoh et al. ..... 345/97
6,727,875 B1 * 4/2004 Mikami et al. ..... 345/92

* cited by examiner

*Primary Examiner*—Vijay Shankar
(74) *Attorney, Agent, or Firm*—McKenna Long & Aldridge LLP

(57) ABSTRACT

A ferroelectric liquid crystal display and method of driving the same according to an impulse-type method improves a voltage holding ratio. The ferroelectric liquid crystal display and method of driving the same applies a scan pulse at least twice to each gate line of a liquid crystal display panel injected with ferroelectric liquid crystal material during one frame period of the liquid crystal display panel. Data voltages are applied to data lines of liquid crystal display panel in synchrony with the scan pulse.

15 Claims, 16 Drawing Sheets

FIG.11A
RELATED ART

ODD-NUMBERED FRAME

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG.11B
RELATED ART

EVEN-NUMBERED FRAME

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

IMPULSE PROPERTY OF CRT

SUSTAIN PROPERTY OF LCD

FERROELECTRIC LIQUID CRYSTAL DISPLAY AND METHOD OF DRIVING THE SAME

This application claims the benefit of Korean Patent Application No. P2002-66582, filed on Oct. 30, 2002, which is hereby incorporated by reference for all purposes as if fully set forth herein.

BACKGROUND OF THE INVENTION

1. Field of the Invention

The present invention relates to ferroelectric liquid crystal displays (LCDs), and more particularly to a ferroelectric LCD and a method of driving the same according to an impulse-type method wherein a voltage holding ratio (VHR) of liquid crystal cells is reduced.

2. Description of the Related Art

Generally, LCDs display pictures by applying electric fields to a layer of liquid crystal material in response to an applied video signal, wherein the applied electric field controls the orientation liquid crystal molecules within the layer of liquid crystal material and therefore the light transmittance characteristics of the liquid crystal material.

FIG. 1 illustrates a related art active matrix LCD (AM-LCD).

Referring to FIG. 1, related art AM-LCDs generally include an LCD panel formed of lower and upper substrates. The lower substrate (i.e., the TFT array substrate) supports a plurality of data lines D1 to Dm and a plurality of gate lines G1 to Gn arranged to cross each other. Liquid crystal cells (Clc) are defined by, and thin film transistors (TFTs) are formed at, the crossings of the gate and data lines, wherein the TFTs are provided for driving corresponding ones of liquid crystal cells. A linear polarization filter having a first polarization axis is mounted onto the rear surface of the TFT array substrate. A protecting film is formed over the entire front surface of the TFT array substrate in order to cover the TFTs and the gate and data lines. An alignment film is formed over the entire surface of the protecting film. Alignment grooves are formed in the alignment film for aligning subsequently provided liquid crystal material. The front surface of the upper substrate (i.e., the color filter substrate) supports a black matrix, a color filter, a common electrode, and an alignment film. The rear surface of the color filter substrate supports a polarization plate. The upper and lower substrates are bonded together by a sealant and liquid crystal material is injected between the bonded substrates. Storage capacitors (Cst) are connected to corresponding ones of the liquid crystal cells (Clc) and allow each liquid crystal cell (Clc) to maintain an applied data voltage.

Storage capacitors (Cst) of each liquid crystal cell (Clc) include an electrode connected to one portion of a corresponding pixel electrode and another electrode connected to a preceding one of the gate line G1 to Gn-1. Gate electrodes of each TFT are connected to the gate lines G1 to Gn that transmit scan pulses. Source electrodes of each TFT are connected to the data lines D1 to Dm that transmit data voltages. Drain electrodes of each TFT are connected to respective ones of the pixel electrodes within the liquid crystal cell (Clc).

The black matrix is formed in boundary regions between adjacent liquid crystal cells (Clc) and in TFT regions of each liquid crystal cell (Clc) to absorb incident light and prevent light transmitted though portions of the liquid crystal material between adjacent liquid crystal cells, having undesirable optical properties, from being displayed by the LCD. The color filter selectively transmits light having predetermined wavelength ranges corresponding to red, green, and blue colors.

Referring to FIG. 2, LCD display pictures by sequentially applying scan pulses SP1 to SPn to the gate lines G1 to Gn. Horizontal lines of liquid crystal cells connected to gate lines having scan pulses applied to them (e.g., having selected gate lines) transmit light in accordance with an analog data voltage applied by the data lines D1 to Dm, wherein the analog data voltage corresponds to a received video signal.

Referring to FIG. 3, scan pulses SP1 to SPn are generated using a shift register having stages ST1 to STn electrically connected to corresponding ones of the gate lines G1 to Gn, respectively. The first stage (ST1) of the shift register generates a scan pulse (SP1) in synchrony with a gate start pulse (GSP) outputted from a timing controller (not shown). The second to nth stages ST2 to STn sequentially generate scan pulses SP2 to SPn, respectively, in response to preceding ones of the scan pulses SP1 to SPn-1, respectively, supplied from the preceding stage. A gate shift clock (GSC) signal and a gate output enable (GOE) signal control the output timing of the scan pulses.

In related art LCDs, during one frame period of the LCD panel (i.e., 16.67 ms, as defined by the National Television System Committee (NTSC)), the scan pulses SP1 to SPn are sequentially applied to the first gate line to the nth gate line G1 to Gn in response to the generated gate start pulse (GSP). Each scan pulse SP1 to SPn is applied to a corresponding gate line G1 to Gn once during one frame period of the LCD panel.

Generally, the liquid crystal material within LCDs exhibits an intermediate material phase between solid and liquid phases wherein liquid crystal molecules exhibit both fluidity and elasticity. Currently, the most common type of liquid crystal material used in LCDs include twisted nematic mode (TN mode) liquid crystal material.

Referring to FIG. 4, a high logic voltage (Vgh) of each scan pulse (SP) is greater than a threshold voltage of a TFT and forms a conductive channel between the source/drain electrodes of the TFT such that liquid crystal cells of TN mode LCDs become charged with a voltage (Vlc). Accordingly, the liquid crystal cell substantially maintains the charged voltage during the entire frame period of the LCD panel. A low logic voltage (Vgl) of the scan pulse (SP) is lower than the threshold voltage of the TFT. A voltage holding ratio (VHR) of each liquid crystal cell is the difference between a peak data voltage (Vdata) of the data voltage applied to the liquid crystal cell and an average voltage (Vavrg) of voltage actually charged by the liquid crystal cell when the peak data voltage (Vdata) is applied. The larger the voltage holding ratio (VHR), the larger the difference between the data voltage applied to the liquid crystal cell and the voltage actually charged by the liquid crystal cell. Accordingly, as the voltage holding ratio increases, the ability to control the brightness of the liquid crystal cell decreases.

Undesirably, TN mode liquid crystal material has a relatively low response speed and a relatively narrow viewing angle. To overcome the aforementioned problems, TN mode liquid crystal material can be replaced by ferroelectric liquid crystal (FLC) material having a response speed and viewing angle generally greater than that of TN mode liquid crystal material. FLC material exhibits a lamellar structure, wherein each layer of FLC material has the same electric and magnetic properties. Accordingly, when FLC material is driven, molecules of FLC material within the same layer spontaneously rotate (i.e., polarize) along a virtual cone in response to an applied electric field. In the absence of an applied electric field, molecules within the FLC material spontaneously polarize to an original alignment orientation. Accordingly, when external electric fields are applied to the FLC material, molecules within the FLC material rotate rapidly by interaction of an external field and exhibit spontaneous polarization. The response speed of FLC material is typically between a hundred or a thousand times faster than other modes of liquid crystal material. Further, FLC material has an inherent in-plane-switching property and can therefore be used to provide LCDs with wide viewing angles without special electrode structures or compensation films. Further, FLC material has an inherent in-plane-switching property and can therefore be used to provide LCDs with wide viewing angles without special electrode structures or compensation films. Depending on its behavior in the presence of applied electric fields, FLC material may be classified as V-Switching or Half V-Switching Modes.

V-Switching Mode FLC material exhibits the following thermodynamic phase transformations upon decreasing temperature: isotropic→smectic A phase (SA)→smectic X phase (Sm X*)→crystalline. At the isotropic phase, molecules within the FLC material are oriented and distributed substantially isotropically (e.g., randomly). At the smectic A phase (SA) phase, molecules within the FLC material are divided into symmetrically arranged layers of vertically arranged molecules. At the smectic X phase (Sm X*) phase, molecules within the FLC material are arranged according to an intermediate order between smectic A and crystalline phases.

FIG. 5 illustrates a graph of transmissivity of incident light versus voltage applied to a V-Switching Mode ferroelectric liquid crystal cell.

Referring to FIG. 5, the transmissivity of light incident to a V-Switching Mode FLC cell exhibiting the smectic X phase (Sm X*) is dependent upon the polarity of an applied driving data voltage (e.g., +V and −V). Accordingly, the arrangement of liquid crystal molecules within V-Switching Mode FLC material may be affected by the applied external voltage. V-Switching Mode FLC material beneficially has high response speed and wide viewing angle characteristics but disadvantageously requires a large amount of power in order to be driven because a capacitance value of the V-Switching Mode FLC material is relatively large. Therefore, a capacitance value of a storage capacitor used to maintain applied data voltages are also be large. Accordingly, if V-Switching Mode FLC material is used LCDs, an aperture ratio of the LCD becomes low since the power consumption of LCD and an electrode area of a sub-capacitor increases.

Half V-Switching Mode FLC material beneficially has a high response speed and wide viewing angle characteristics and further has a relatively low capacitance value. Therefore, Half V-Switching Mode FLC material is often used to display moving pictures.

FIG. 6 illustrates phase transformations of Half V-Switching Mode ferroelectric liquid crystal material.

Referring to FIG. 6, upon decreasing temperature below the phase transformation temperature (Tni), Half V-Switching Mode FLC material exhibits a phase transformation from the isotropic to the nematic phase (N*), below phase transformation temperature (Tsn), the Half V-Switching Mode FLC material exhibits a phase transformation from the nematic phase (N*) to the smectic C phase (Sm C*), and below phase transformation temperature (Tcs) the Half V-Switching Mode FLC material exhibits a phase transformation from the smectic C phase to the crystalline phase. Therefore, as the temperature decreases, Half V-Switching Mode FLC material exhibits the following thermodynamic phase transformations: isotropic→nematic (N*)→smectic C phase (Sm C*)→crystalline.

FIG. 7 illustrates the fabrication of a liquid crystal cell including Half V-Switching Mode FLC material.

Referring to FIG. 7, Half V-Switching Mode FLC material is typically injected into a liquid crystal cell at a temperature above Tni. Accordingly, upon being injected into the liquid crystal cell, molecules within the FLC material are oriented and distributed substantially isotropically (e.g., randomly). Upon lowering the temperature of the FLC material below Tni, molecules within the FLC material become aligned substantially parallel to each other along a direction dictated by the rubbing direction of an orientation layer and the FLC material exhibits the nematic phase (N*). If the temperature of the FLC material is further lowered the temperature below Tsn in the presence of an electric field, the FLC material exhibits the smectic phase (C*) and the liquid crystal molecules spontaneously polarize along the direction of the applied electric field to exhibit a monostable state, wherein liquid crystal molecules uniformly assume one of two possible molecular arrangements. If, on the other hand, the temperature of the FLC material is lowered below Tsn in the absence of the applied electric field, the liquid crystal molecules become separated into layers to exhibit a bistable state, wherein liquid crystal molecules within each layer uniformly assume one of the two possible molecular arrangements. Further, the distribution of the molecular arrangements within the layers is substantially random. In view of the above, it generally more difficult to uniformly control of the FLC material exhibiting the bistable than to uniformly control of the FLC material exhibiting the monostable state. Accordingly, the Half V-Mode FLC cells are generally fabricated to exhibit the monostable state by cooling the FLC material below Tsn in the presence of an electric filed generated by applying a small direct current (DC) voltage to the LCD panel.

Referring still to FIG. 7, the symbol "⊗" describes the direction of the applied electric field as extending out of the plane of the illustration. Therefore the spontaneous polarization direction of the FLC material also extends out of the plane of the illustration. Accordingly, electrodes used to generate the applied electric field are formed on upper and lower plates of the liquid crystal cell, extending out of the plane of the illustration. Further, the orientation layer described above is formed on the upper and lower plates.

FIGS. 8A and 8B illustrate the dependence of light transmissivity on a voltage applied to a Half V-Switching Mode FLC cell.

Referring to FIG. 8A, Half V-Switching Mode FLC cells containing FLC material aligned in the presence of an applied electric field generated by a voltage having a negative polarity (−V) (i.e., fabricated in the presence of an electric field having a negative polarity), transmit light in the presence of an applied voltage having a positive polarity (+V) by rotating a polarization axis of the light by 90°. The light transmissivity of the Half V-Switching Mode FLC cell increases proportionally to the intensity of an applied positive electric field generated by the positive voltage (+V). Further, the light transmissivity of the Half V-Switching Mode FLC cell attains a maximum value when the intensity of the applied positive electric field is greater than a fixed threshold value of the FLC material. In the presence of an applied voltage having a negative voltage (−V), the Half V-Switching Mode FLC cell does not rotate the polarization axis of the light. Accordingly, in the presence of an applied voltage having a negative polarity, the Half V-Switching Mode FLC cell transmits substantially no light (i.e., the Half V-Switching Mode FLC cell intercepts the light).

Referring to FIG. 8B, Half V-Switching Mode FLC cells containing FLC material aligned in the presence of an applied electric field generated by a voltage having a positive polarity (+V) (i.e., fabricated in the presence of an electric field having a positive polarity), transmit light in the presence of an applied voltage having a negative polarity (−V). Further, in the presence of an applied voltage having a positive polarity (+V), the Half V-Switching Mode FLC cell does not rotate the polarization axis of the light. Accordingly, in the presence of an applied voltage having a positive polarity, the Half V-Switching Mode FLC cell intercepts the light.

FIGS. 9A and 9B illustrate the orientation directions of Half V-Switching Mode FLC material in the presence of applied electric fields used to fabricate the liquid crystal cell and applied electric fields used to drive the liquid crystal cell, respectively.

Referring to FIG. 9A, when the Half V-Switching Mode FLC cell is fabricated in the presence of an externally applied electric field generated by a voltage having a negative polarity, the spontaneous polarization direction (Ps) of FLC material becomes uniformly aligned to the direction of the externally applied electric field having the negative polarity (E(−)). Referring to FIG. 9B, if, during a subsequent driving of the LCD panel, an electric field having a positive polarity (e.g., an electric field generated by applying a voltage having a positive polarity to the LCD panel) (E(+)) is applied to the fabricated Half V-Switching Mode FLC cell, the FLC material spontaneously polarizes along a spontaneous polarization direction (Ps) uniformly aligned with the direction of the applied electric field having the positive polarity. Accordingly, a polarization state of light incident to a lower plate of the LCD panel may be rotated to substantially align with the polarization direction of an upper polarizer on an upper plate via the FLC material, having the spontaneous polarization direction (Ps) uniformly aligned with the externally applied electric field having the positive polarity, and the incident light is transmitted through the upper plate. If, however, during driving of the LCD panel, the applied external electric field is generated by an applied voltage having a negative polarity (and thus itself has a negative polarity (E(−)), or if, during driving, no electric field is applied, the FLC material remains uniformly aligned along its initial spontaneous polarization direction (Ps) (characterized by the applied electric field having the negative polarity) and the incident light beam is not transmitted through the upper plate (i.e., the light is intercepted by the liquid crystal cell).

Referring to FIG. 10, the brightness of the Half V-Switching Mode FLC cell described above is relatively low and cannot precisely express images consistent with received video signals because the average voltage (Vavrg) charged within each liquid crystal cell is low and the voltage holding ratio (VHR) is excessively large. More specifically, the Half V-Switching Mode FLC cell immediately discharges the charged voltage after the peak data voltage (Vdata) is charged when the scan pulse (SP) attains the high logic voltage (Vgh). Accordingly, the liquid crystal cell cannot effectively express gray scale values of expressed images consistent with the received video signal and the brightness becomes much reduced compared to the brightness required by the received video signal when the voltage of the Half V-Switching Mode FLC cell drops abruptly as described above because the average voltage (Vavrg) of the liquid crystal cell becomes much smaller than the peak voltage of the data voltage (Vdata).

If, during fabrication, the entire LCD panel is uniformly aligned under an applied electric field having a single polarity (e.g., a positive polarity (+) or a negative polarity (−)), defects may be generated within the fabricated Half V-Switching Mode FLC cell when the LCD panel is driven according to an inversion driving method. Such defects may be manifested by the lowering of a brightness of displayed pictures and flickering (e.g., blinking) of the displayed pictures. Such flickering may be reduced by employing inversion driving methods to drive LCD panels, wherein the inversion driving methods also prevent a degradation of liquid crystal material within the LCD panel by inverting the polarity of applied data voltages between predetermined periods of the LCD panel. For example, a frame inversion driving method inverts the polarity of data voltages applied between successive frame periods at a frequency of 60 Hz, in correspondence with the frame period of 16.7 ms. A line inversion driving method inverts the polarity of data voltages between successive frame periods and horizontal lines. A column inversion driving method inverts the polarity of data voltages between successive frame periods and vertical lines. Lastly, a dot inversion driving method inverts the polarity of data voltages between successive frame periods, horizontal lines, and vertical lines, as shown in FIGS. 11A and 11B. Because the polarity of data voltages can be inverted between successive frame periods, horizontal lines, and vertical lines, the dot inversion driving method is most commonly used within LCDs to minimize flickering.

Further, LCDs including the aforementioned Half V-Switching Mode FLC cells, fabricated in the presence of a uniformly applied electric field having a negative polarity and arranged in a matrix pattern, may be driven according to the dot inversion driving method. Accordingly, and with reference to FIGS. 11A and 11B, horizontally and vertically adjacent ones of Half V-Switching Mode FLC cells arranged within an LCD panel may alternately transmit and intercept light because each Half V-Switching Mode FLC cells can only transmit light in the presence of an applied electric field having a positive polarity. For example, odd ones of the FLC cells arranged within odd horizontal lines of liquid crystal cells and even ones of the FLC cells arranged within even horizontal lines of liquid crystal cells transmit light in response to an electric field having a positive polarity (+) applied during odd frames (see FIG. 12A) and intercept light in response to an electric field having a negative polarity (−) applied during even frames (see FIG. 12B). Moreover, even ones of the FLC cells arranged within odd horizontal lines of liquid crystal cells and odd ones of the FLC cells arranged within even horizontal lines of liquid crystal cells transmit light in response to an electric field having a positive polarity (+) applied during even frames (see FIG. 12B) and intercept light in response to an electric field having a negative polarity (−) applied during odd frames (see FIG. 12A).

LCDs including a plurality of Half V-Switching Mode FLC cells, fabricated in the presence of a uniformly applied electric field having a negative polarity and arranged in a matrix pattern, may be driven according to the dot inversion driving method. Accordingly, and with reference to FIGS. 12A and 12B, horizontally and vertically adjacent ones of Half V-Switching Mode FLC cells arranged within an LCD panel may alternately transmit and intercept light because each Half V-Switching Mode FLC cells can only transmit light in the presence of an applied electric field having a positive polarity. For example, odd ones of the FLC cells arranged within odd horizontal lines of liquid crystal cells and even ones of the FLC cells arranged within even horizontal lines of liquid crystal cells transmit light in response to an electric field having a positive polarity (+) applied during odd frames (see FIG. 12A) and intercept light in response to an electric field having a negative polarity (−) applied during even frames (see FIG. 12B). Moreover, even ones of the FLC cells arranged within odd horizontal lines of liquid crystal cells and odd ones of the FLC cells arranged within even horizontal lines of liquid crystal cells transmit light in response to an electric field having a positive polarity (+) applied during even frames (see FIG. 12B) and intercept light in response to an electric field having a negative polarity (−) applied during odd frames (see FIG. 12A).

Referring still to FIG. 12A and FIG. 12B, reference numerals 'P1' and 'P2' indicate the polarization axes of polarization plates arranged on upper and lower substrates of the LCD panel, respectively. The polarization axis of each polarization plate determines polarization characteristics of light it will transmit. As shown in the Figures, the polarization axes of the upper and lower polarization plates are substantially perpendicular to each other. Within liquid crystal cells transmitting light, light having a polarization direction parallel to P1 (or P2) is transmitted by an incident polarization plate, through the FLC material, and is subsequently transmitted by a display polarization plate where the light transmitted by the display polarization plate has a polarization direction parallel to P2 (or P1). Within the liquid crystal cells intercepting light, light having a polarization direction parallel to P1 (or P2) is transmitted by an incident polarization plate is not transmitted to the display polarization plate having the polarization axis of P2 (or P1).

FIG. 13 illustrates a graph of a data voltage charged to a Half V-Switching Mode FLC cell within an LCD panel and the corresponding light transmissivity characteristics of the liquid crystal cell.

Referring to FIG. 13, a driving data voltage having a frequency of 60 Hz is uniformly applied to aforementioned FLC cells (e.g., FLC cells fabricated in the presence of an applied electric field having a negative polarity) arranged within the LCD panel. Accordingly, the polarity of the applied driving data voltage is inverted each successive frame period of the LCD panel (i.e., 16.7 ms). As a result, the FLC cells transmit light during odd frame periods 1Fr, 3Fr, 5Fr, etc., when the applied driving data voltage generates an electric field having a positive polarity (e.g., when the applied driving data voltage has a positive polarity, +V), and transmits substantially no light (i.e., intercepts light) when the applied driving data voltage generates an electric field having a negative polarity (e.g., when the applied driving data voltage has a negative polarity, −V). Therefore, when LCD panels including uniformly fabricated Half V-Switching Mode FLC cells are driven, the overall brightness of the LCD panel decreases and pictures displayed by the LCD panel appear to flicker because viewers perceive the transmitted light periodically within each frame period of the LCD panel.

Further, blurring or contour trailing occurs when the LCD panel displays moving pictures due to a slow response time of the FLC material and due to predetermined maintenance characteristics of the FLC material. Cathode ray tubes (CRTs) do not display pictures by maintain data voltages. Rather, CRTs are a type of impulse display system capable of displaying pictures instantaneously. Accordingly, the aforementioned blurring or contour trailing does not occur when moving pictures are displayed by CRTs. Referring to FIG. 14, CRTs display pictures by irradiating electrons onto a portion of a fluorescent screen for short amount of time within each frame period. Accordingly, each portion of the fluorescent screen remains dark for a portion of each frame period. In contrast, and with reference to FIG. 15, LCDs display pictures by charging data voltages to liquid crystal cells during a scanning period when gate high voltages (Vgh) are applied, wherein, once they are charged, the data voltages are maintained within the liquid crystal cells until they are refreshed in a successive frame period.

SUMMARY OF THE INVENTION

Accordingly, the present invention is directed to a ferroelectric liquid crystal display and method of driving the same that substantially obviates one or more of the problems due to limitations and disadvantages of the related art.

An advantage of the present invention provides a ferroelectric LCD and a method of driving the same according to an impulse-type method wherein a voltage holding ratio (VHR) of liquid crystal cells is reduced.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, the ferroelectric LCD may, for example, include a LCD panel having liquid crystal cells arranged in a matrix pattern, ferroelectric liquid crystal injected into the liquid crystal cells, gate lines, and data lines crossing the gate lines; a gate driving circuit for applying scan pulses at least twice to each gate line during one frame period of the LCD panel; and a data driving circuit for applying data voltages to the data lines of the LCD panel in synchrony with scan pulses.

In one aspect of the present invention, each liquid crystal cell may be provided as a Half V-Switching Mode FLC cell.

In another aspect of the present invention, the ferroelectric LCD may further include a timing controller for controlling the data driving circuit and the gate driving circuit.

In yet another aspect of the present invention, the timing controller may generate a multiple gate start pulse and apply the multiple gate start pulse to the gate driving circuit, wherein the multiple gate start pulse cause the gate driving circuit to sequentially generate scan pulses.

In still another aspect of the present invention, the multiple gate start pulse may be generated at least twice during one frame period of the LCD panel.

In still a further aspect of the present invention, the data driving circuit may apply the same data voltages to data lines of the LCD panel at least twice during one frame period of the LCD panel.

In one aspect of the present invention, the data driving circuit may maintain a polarity of data voltages applied to the data lines of the LCD panel during one frame of the LCD panel.

In another aspect of the present invention, the data driving circuit may invert a polarity of the data voltages applied to the data lines of LCD panel at least twice during one frame period of the LCD panel.

In still another aspect of the present invention, the timing controller may, for example, include a memory device for storing data so that the same data may be applied at least twice to the LCD panel during one frame period of the LCD panel.

In accordance with the principles of the present invention, a driving method of the ferroelectric liquid crystal display may, for example, include applying a scan pulse to each gate line of a LCD panel at least twice during one frame period of the LCD panel, wherein the LCD panel is injected with FLC material; and applying data voltages to data lines of the LCD panel in synchrony with the scan pulses.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 11A and 11B illustrate a dot inversion driving method of driving a liquid crystal display panel;

DETAILED DESCRIPTION OF THE ILLUSTRATED EMBODIMENTS

Reference will now be made in detail to embodiments of the present invention, examples of which are illustrated in the accompanying drawings.

Figure 1:
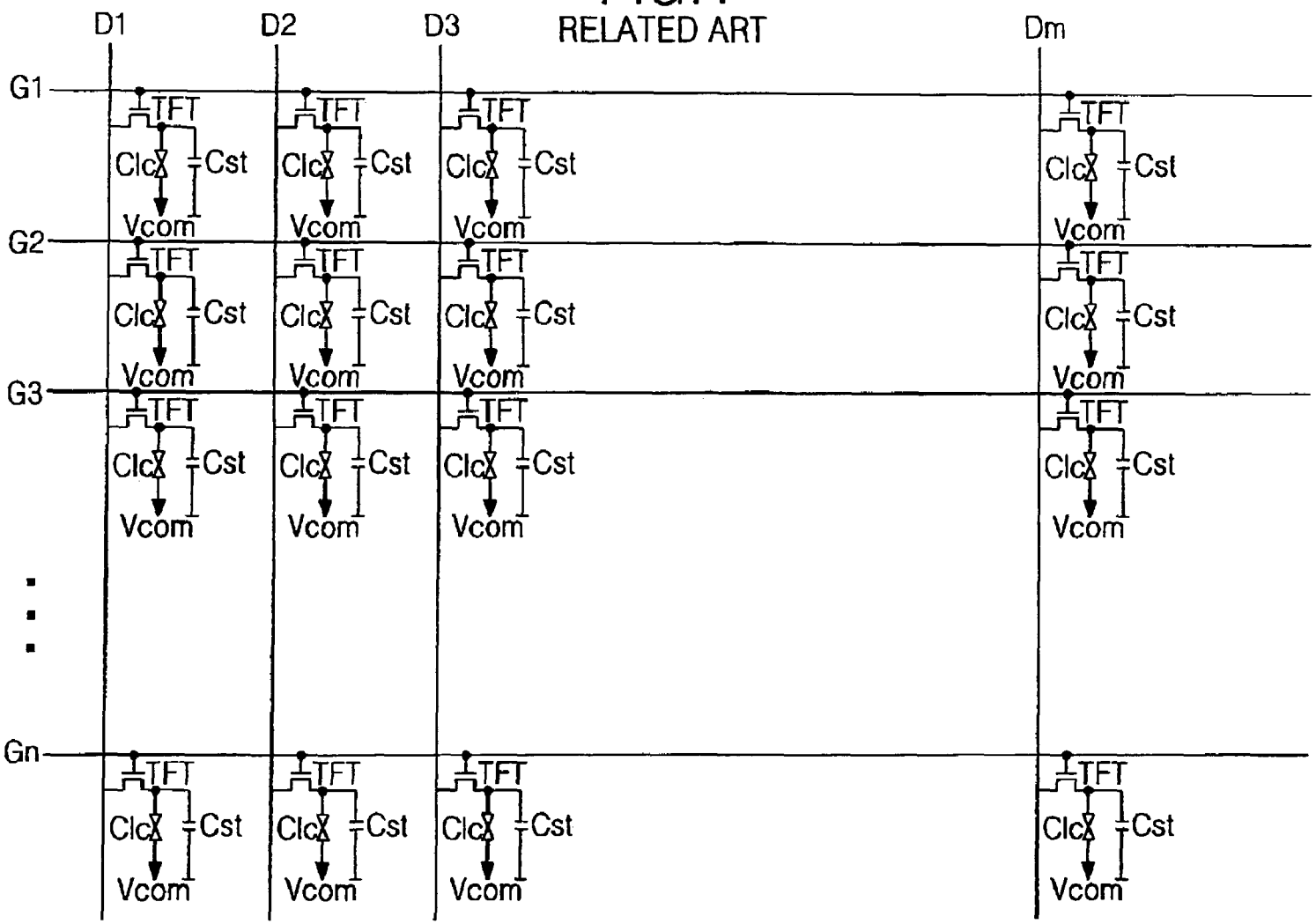
FIG. 1 RELATED ART
FIG. 1 illustrates an equivalent circuit diagram of a related art active matrix liquid crystal display.
Figure 2:
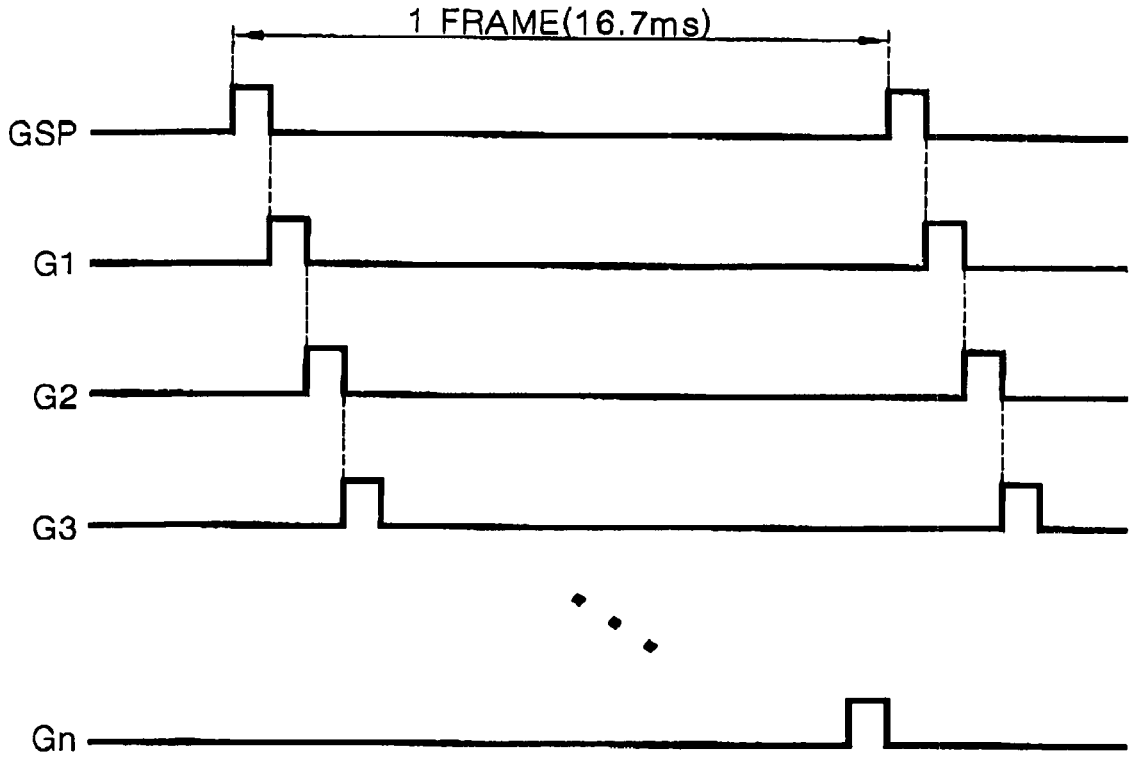
FIG. 2 RELATED ART
FIG. 2 illustrates a waveform diagram of scan pulses applied to gate lines of the liquid crystal display panel shown in FIG. 1.
Figure 3:
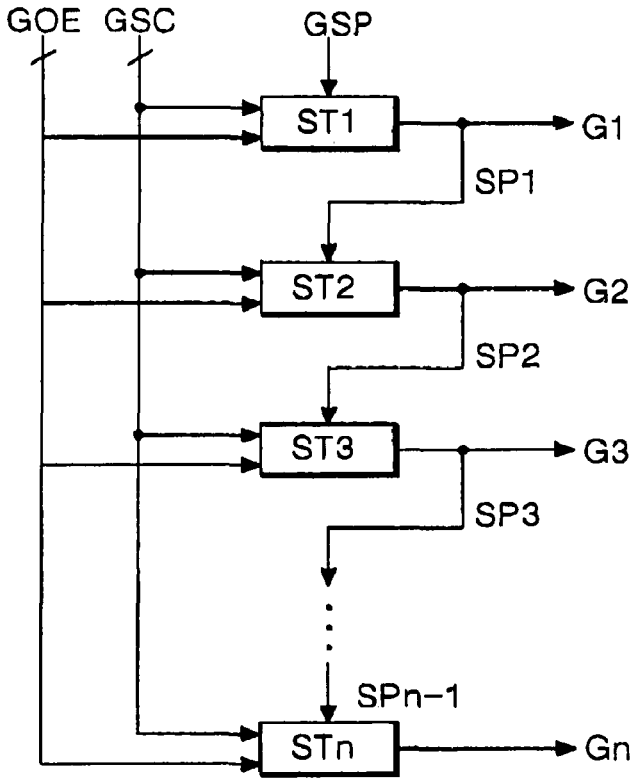
FIG. 3 RELATED ART
FIG. 3 illustrates an equivalent circuit diagram of a gate driving circuit for generating the scan pulses shown in FIG. 2.
Figure 4:
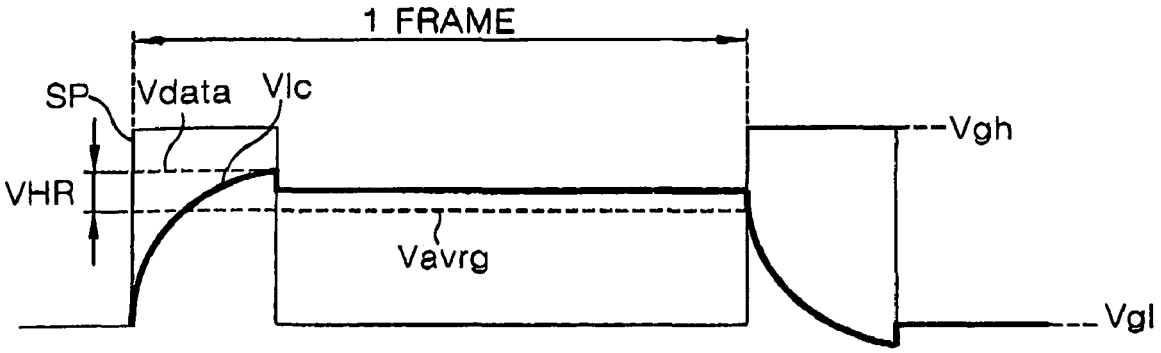
FIG. 4 RELATED ART
FIG. 4 illustrates a waveform diagram of the scan pulses shown in FIG. 2 and a data voltage supplied to a liquid crystal cell of a liquid crystal display panel in synchrony with the scan pulses.
Figure 5:
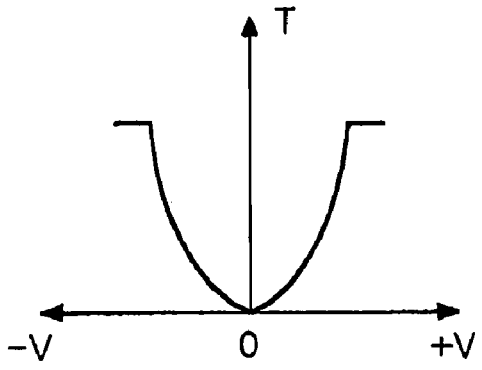
FIG. 5 RELATED ART
FIG. 5 illustrates a relationship between transmissivity of incident light and driving data voltages applied to V-Switching Mode ferroelectric liquid crystal cells.
Figure 6:
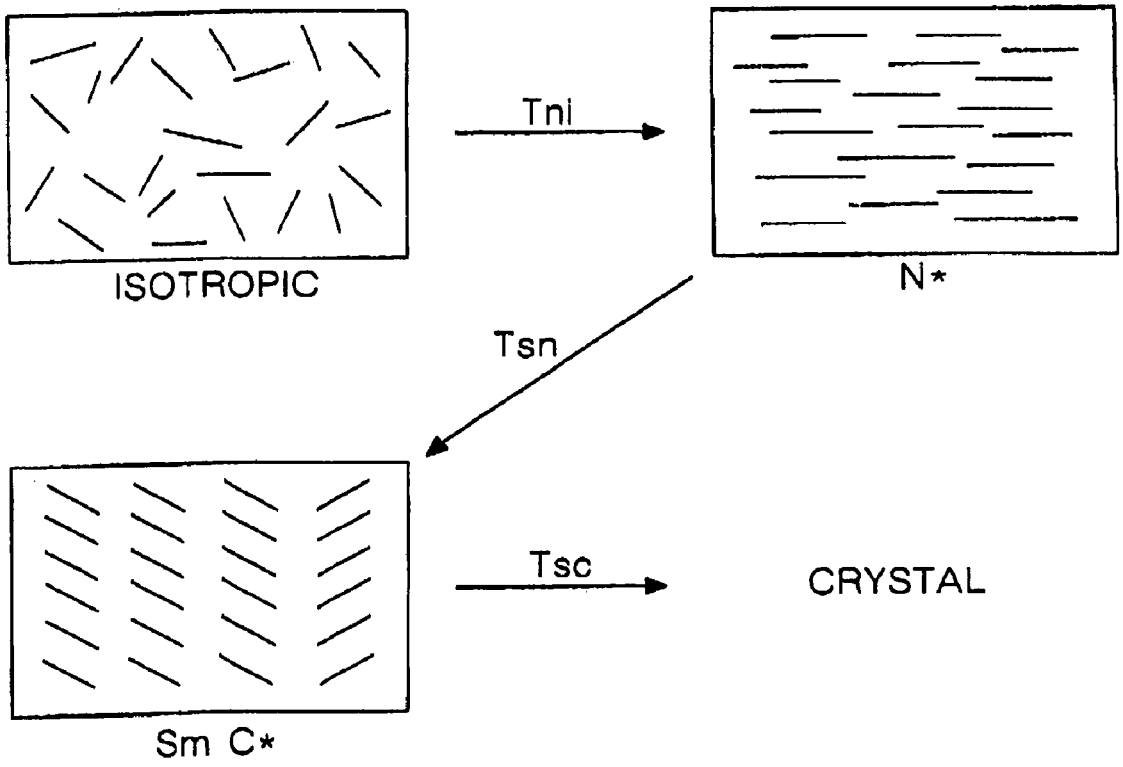
FIG. 6 RELATED ART
FIG. 6 illustrates phase transformations of Half V-Switching Mode ferroelectric liquid crystal material.
Figure 7:
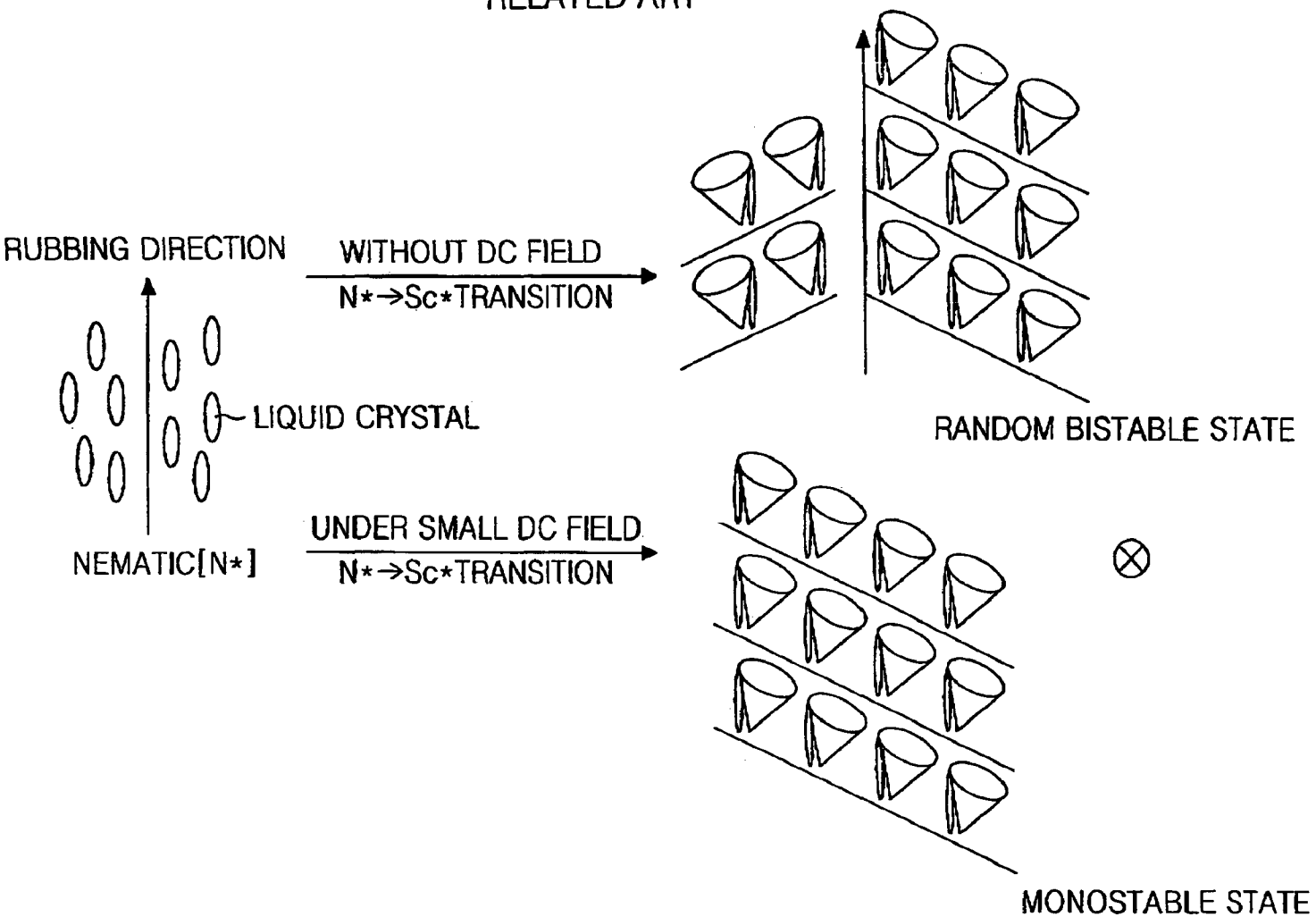
FIG. 7 RELATED ART
FIG. 7 illustrates the fabrication of a liquid crystal cell including Half V-Switching Mode ferroelectric liquid crystal material.
Figure 8A:
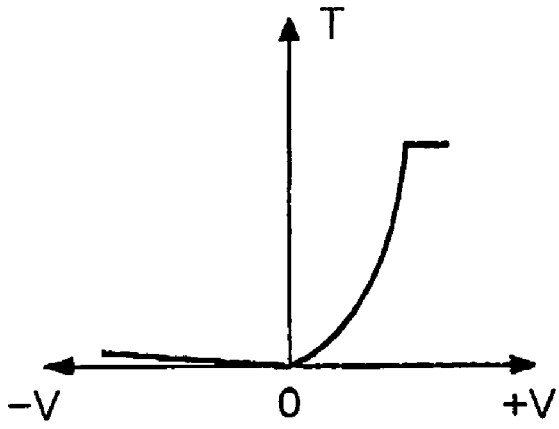
FIG.8A RELATED ART
FIGS. 8A and 8B illustrate a relationship between transmissivity of incident light and driving data voltages applied to V-Switching Mode ferroelectric liquid crystal cells aligned in the presence of applied electric fields having opposite polarities.
Figure 8B:
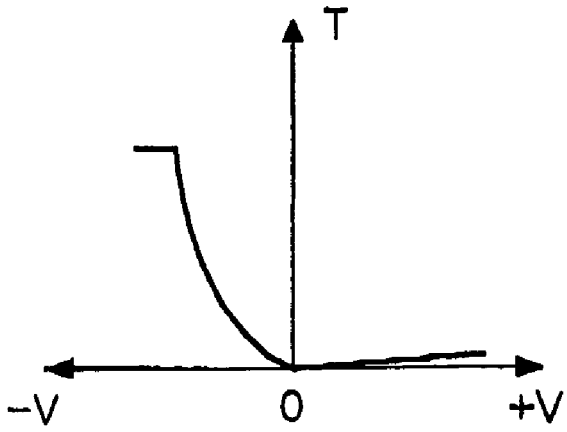
FIG.8B RELATED ART
Figure 9A:
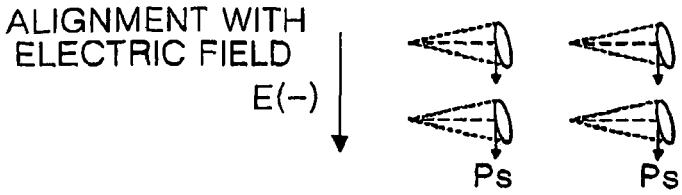
FIG.9A RELATED ART
FIGS. 9A and 9B illustrate an orientation of Half V-Switching Mode ferroelectric liquid crystal material aligned in the presence of an applied electric field and orientations of Half V-Switching Mode ferroelectric liquid crystal material driven in the presence of electric fields having polarities substantially identical to, and different from, the polarity of the applied electric field present during the alignment.
Figure 9B:
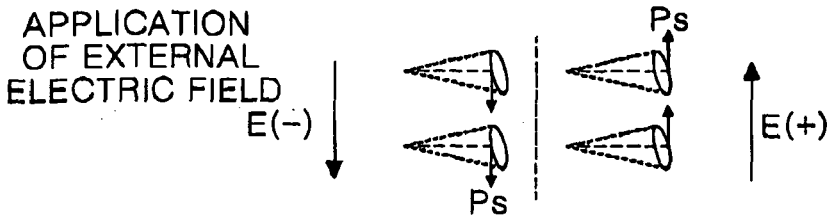
FIG.9B RELATED ART
Figure 10:
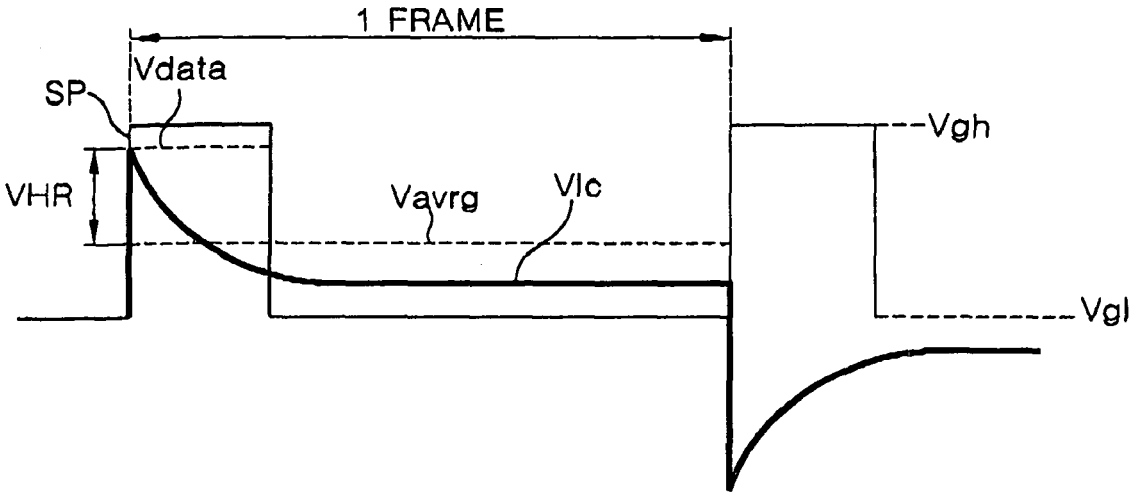
FIG.10 RELATED ART
FIG. 10 illustrates a waveform diagram of scan pulses shown in FIG. 2 and a data voltage supplied to a liquid crystal cell of Half V-Switching Mode in synchrony with the scan pulses.
Figure 12A:
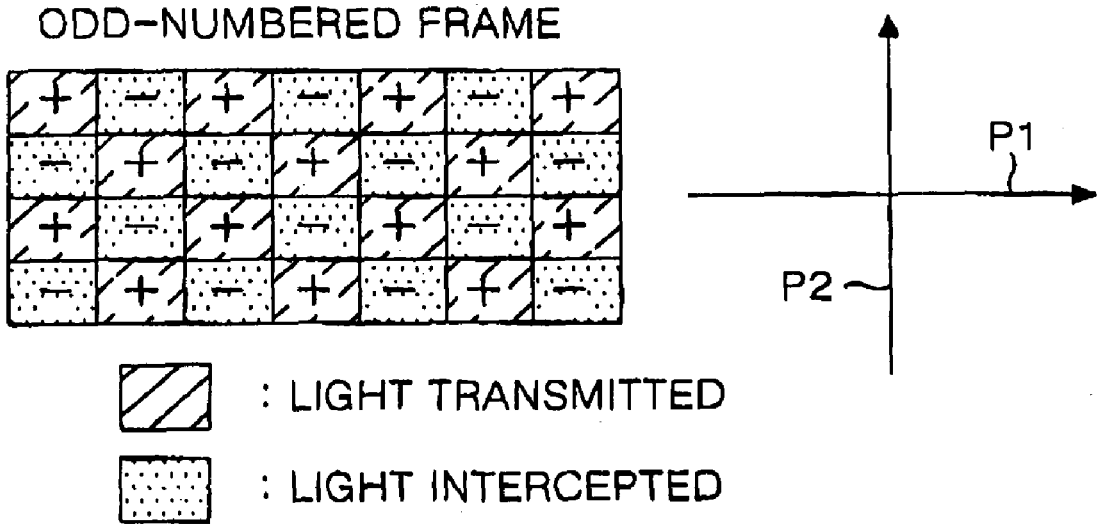
FIG. 12A RELATED ART
FIGS. 12A and 12B illustrate light transmission and interception characteristics of uniformly aligned Half V-Switching Mode ferroelectric liquid crystal cells driven in accordance with the dot inversion driving method.
Figure 12B:
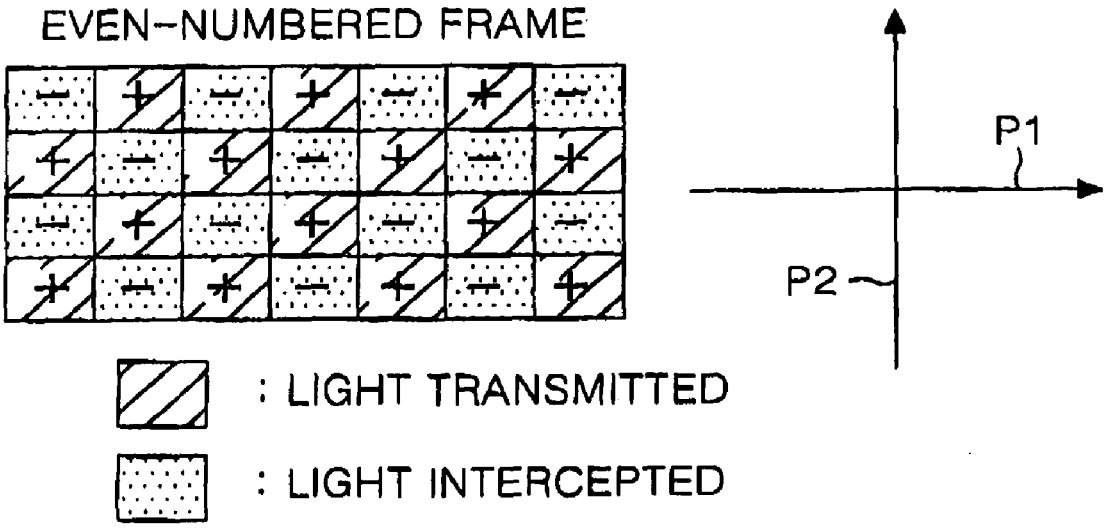
FIG. 12B RELATED ART
Figure 13:
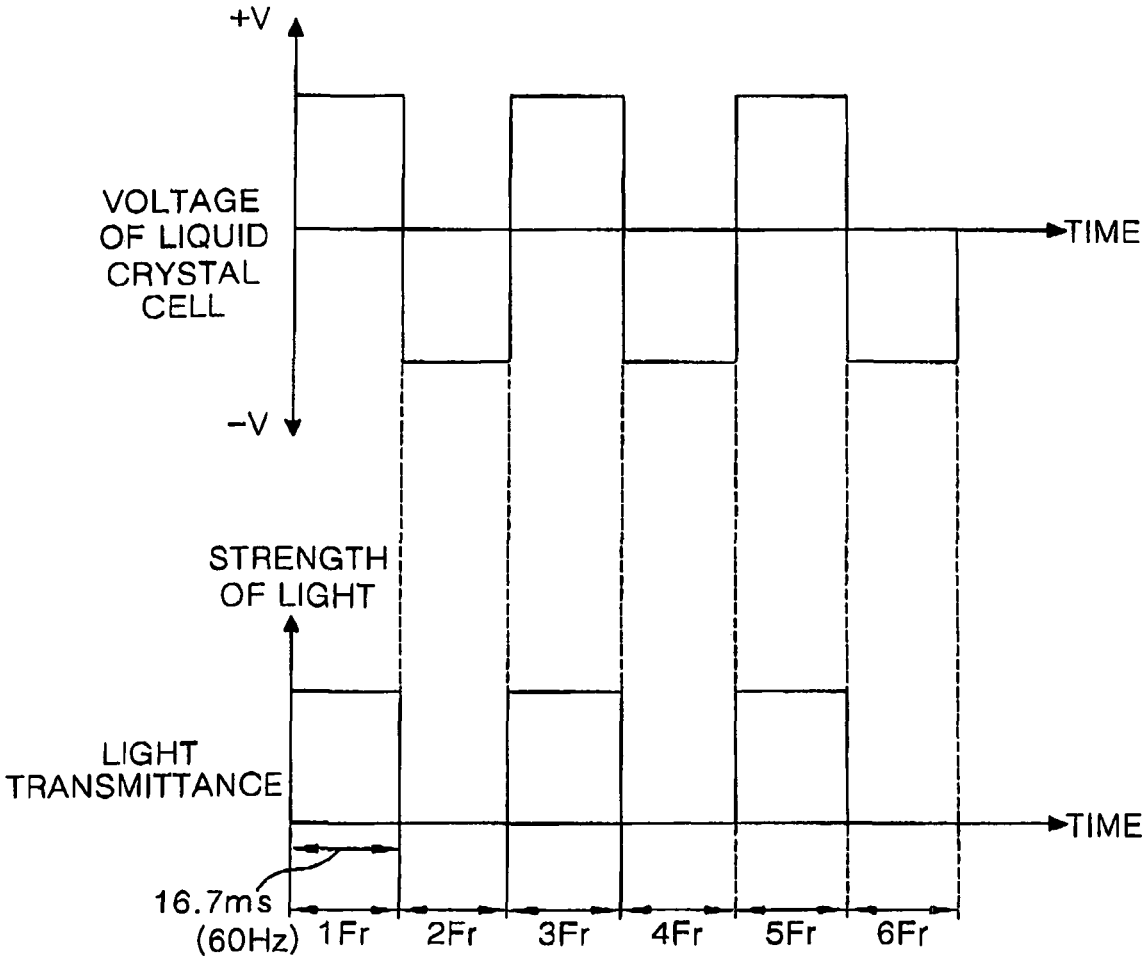
FIG.13 RELATED ART
FIG. 13 illustrates a graph of a driving data voltage charged to Half V-Switching Mode ferroelectric liquid crystal cells and light transmissivity characteristics of the liquid crystal cells corresponding to the charged driving data voltage.
Figure 14:
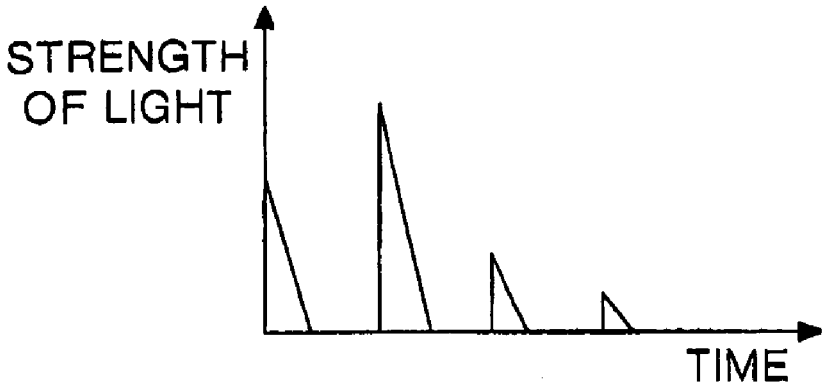
FIG.14 RELATED ART
FIG. 14 illustrates light transmissivity characteristics of a cathode ray tube.
Figure 15:
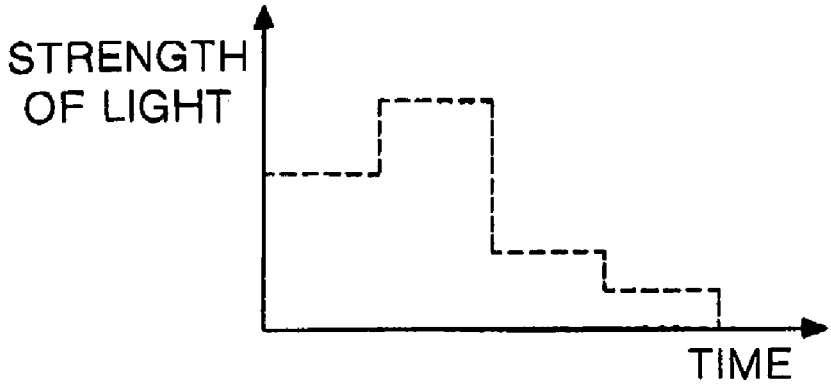
FIG.15 RELATED ART
FIG. 15 illustrates light transmissivity characteristics of a related art liquid crystal display.
Figure 16:
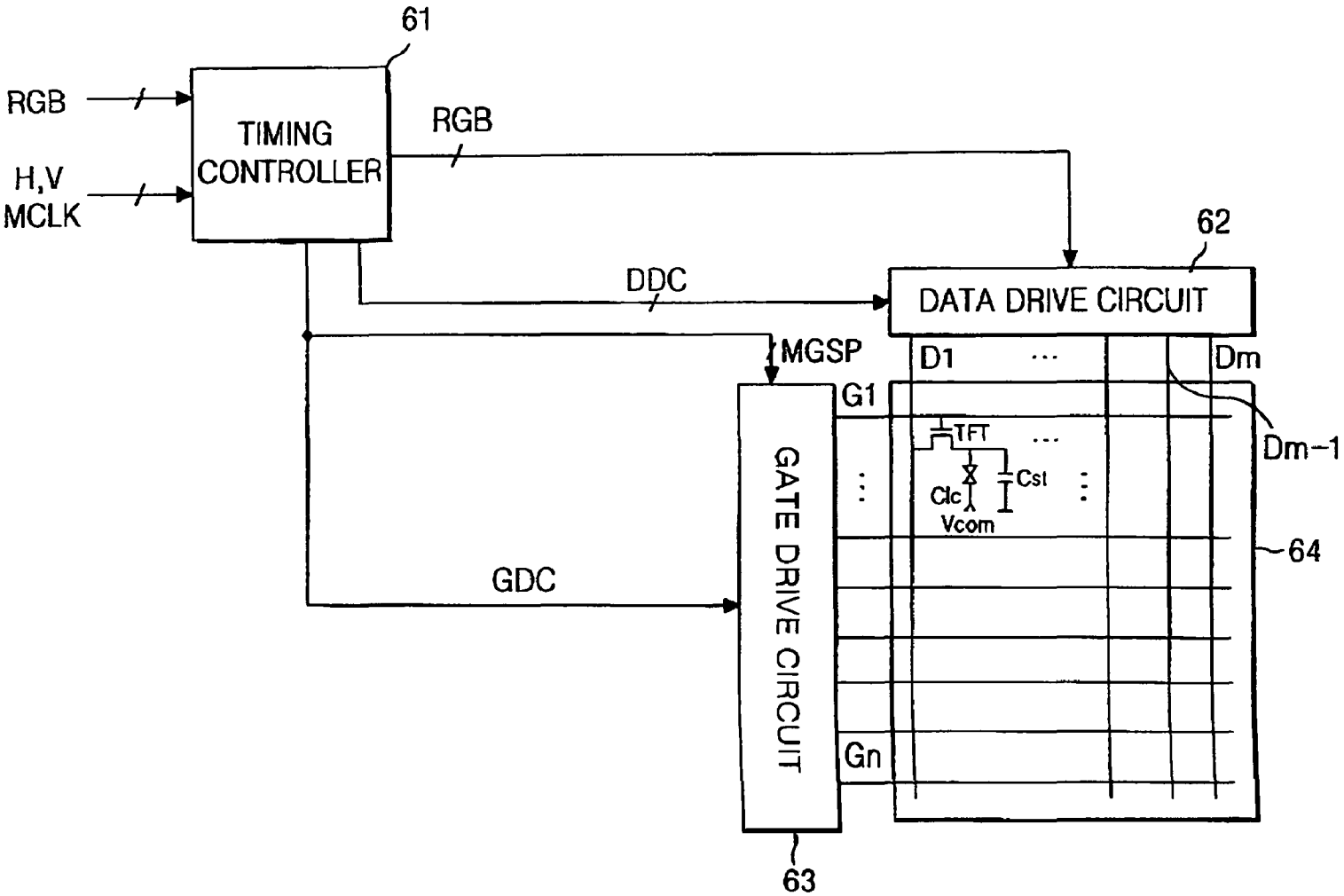
FIG. 16 illustrates a block diagram of a ferroelectric liquid crystal display according to the principles of the present invention.
Figure 17:
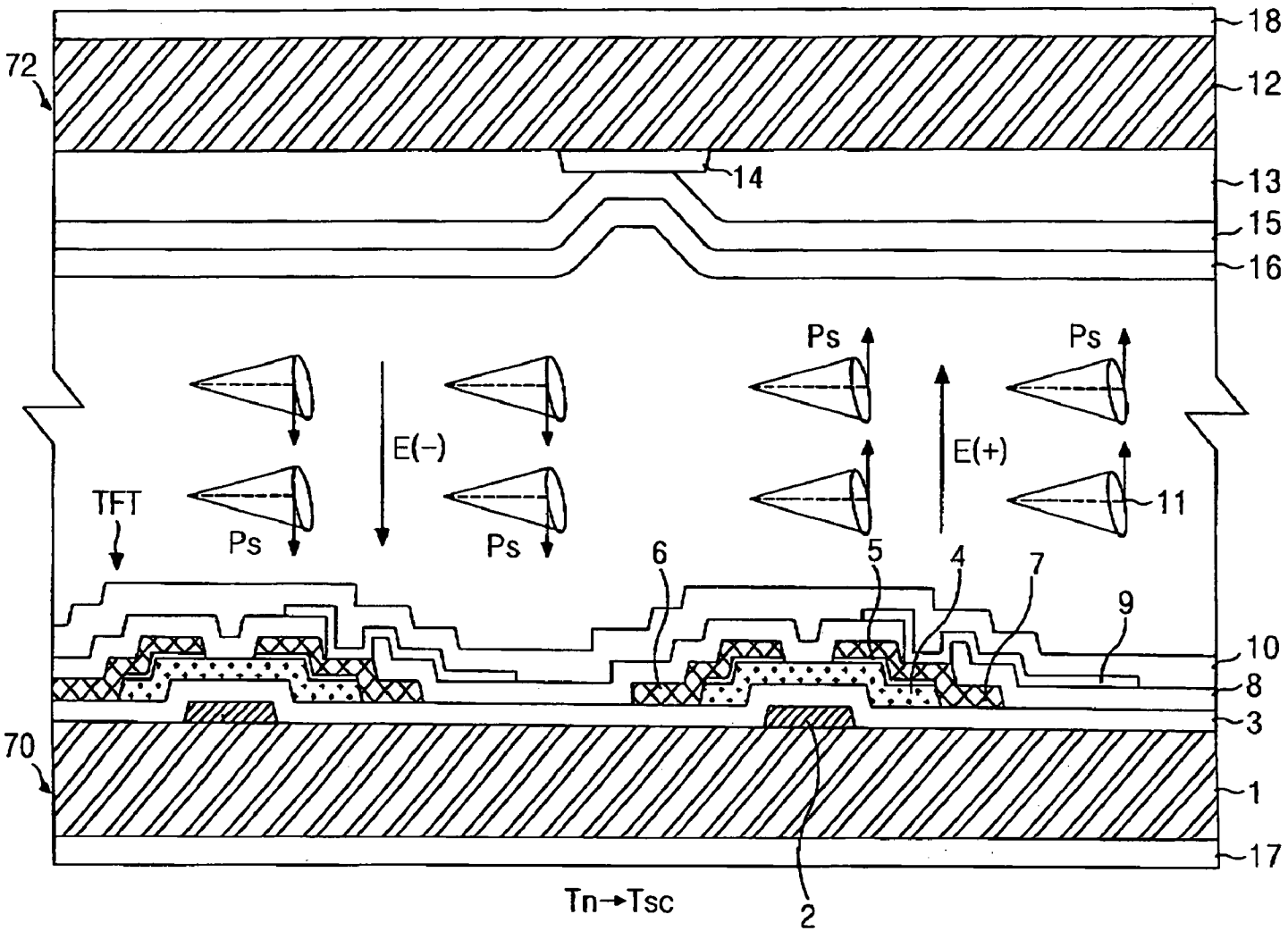
FIG. 17 illustrates a cross-sectional view of liquid crystal cells arranged within two adjacent vertical lines of liquid crystal cells of a ferroelectric liquid crystal display in accordance with the principles of the present invention.

FIG. 16 illustrates a driving apparatus of liquid crystal display according to the principles of the present invention. FIG. 17 illustrates a cross-sectional view of two adjacent liquid crystal cells of a ferroelectric liquid crystal display in accordance with the principles of the present invention.

Referring to FIGS. 16 and 17, a liquid crystal display according to the principles of the present invention may, for example, include an LCD panel 64 having a plurality of Half V-Switching Mode FLC cells arranged in matrix pattern, a data driving circuit 62 for applying data voltages to data lines D1 to Dm of LCD panel 64, a gate driving circuit 63 for applying scan pulses to gate lines G1 to Gn of LCD panel 64, and a timing controller 61 for controlling the data and gate driving circuits 62 and 63.

Referring to FIG. 17, the LCD panel 64 may, for example, include a TFT array substrate 70 and a color filter array substrate 72 coupled to, and spaced apart from, each other using a sealant (not shown). Ferroelectric liquid crystal (FLC) material may be injected between the TFT and color filter array substrates 70 and 72, respectively.

The TFT array substrate 70 may include first and second metallic layers deposited and patterned on a lower substrate 1. The first metallic layer may be deposited and patterned to form a plurality of gate electrodes 2 protruding from respective ones of the gate lines G1 to Gn. Accordingly, scan signals (e.g., gate high voltages) may be applied to gate electrodes 2 of each TFT via respective ones of the gate lines G1 to Gn. The second metallic layer may be deposited and patterned to form a plurality of source electrodes 6 protruding from respective ones of the data lines D1 to Dm and a plurality of drain electrodes 7, spaced apart from respective ones of the plurality of source electrodes 6. The plurality of drain electrodes may be connected to respective ones of subsequently formed pixel electrodes 9 within each liquid crystal cell. A gate insulating film 3 formed of an inorganic insulating material may be formed between the two patterned metallic layers and electrically insulate the first metallic layer from the second metallic layer. An active layer 4 and an ohmic contact layer 5 may be formed between the gate insulating film 3 and the source and drain electrodes 6 and 7, to provide a channel between the source and drain electrodes of the TFT. In one aspect of the present invention, the active layer 4 may be formed of intrinsic amorphous silicon material. In another aspect of the present invention, the ohmic contact layer 5 may be formed of semiconductor material doped with n-type or p-type impurities. A protection layer 8, formed of an organic or inorganic insulating material may be formed over the entire surface of the lower substrate 1, including the TFTs and the gate insulating film 3. Pixel electrodes 9 may be formed to electrically connect with respective ones of the previously formed drain electrodes 7 through contact holes formed in predetermined regions of the protection layer 8. A first alignment film 10 may be formed over the entire surface of the lower substrate 1 and may contact subsequently injected FLC material 11. In one aspect of the present invention, the surface of the first alignment film 10 that is contactable by the FLC material may include a plurality of grooves (not shown) for aligning molecules of liquid crystal material along a first alignment direction. A first polarization plate 17 may be mounted to the rear surface of lower substrate 1 for selectively transmitting light having a first linear polarization direction.

The color filter array substrate 72 may include an upper substrate 12 supporting a black matrix 14 layer, wherein the black matrix layer 14 prevents light leakage at a boundary region between adjacent liquid crystal cells provided with liquid crystal material having undesirable optical transmittance properties. A color filter layer 13 may be provided over the black matrix layer 14 for selectively transmitting light having predetermined wavelength ranges corresponding to red, green, and blue colors. A common electrode 15 may be formed over the entire surface of the upper substrate 12 including the black matrix layer 14 and the color filter layer 13. In one aspect of the present invention, the common electrode 15 may be formed of a transparent conductive material. In another aspect of the present invention the common electrode 15 may be formed via a evaporation deposition technique or the like. A second alignment film 16 may be formed over the entire surface of the upper substrate 12 and may contact subsequently injected FLC material 11. In one aspect of the present invention, the surface of the second alignment film 16 that is contactable by the FLC material may include a plurality of grooves (not shown) for aligning molecules of liquid crystal material along a second alignment direction, substantially parallel to the first alignment direction. A second polarization plate 18 may be mounted to the front surface of the upper substrate 12 for selectively transmitting light having a second linear polarization direction. In one aspect of the present invention, the first linear polarization direction and the second linear polarization direction may be substantially perpendicular.

In accordance with the principles of the present invention, the FLC material 11 may be provided as Half V-Switching Mode FLC material. In one aspect of the present invention, the FLC material may be injected at a temperature at which the FLC material exhibits an isotropic phase. The temperature of the injected FLC material exhibiting the isotropic phase may then be lowered below a first phase transformation temperature (Tni) such that the cooled injected FLC material exhibits a nematic phase (N*). Next, the temperature of the cooled FLC material exhibiting the nematic phase (N*) may be lowered below a second phase transformation temperature (Tsn) while applying an electric filed to the LCD panel sufficient to induce a spontaneous polarization of the FLC material. Accordingly, the FLC material may be aligned in correspondence with the applied electric field as the FLC material is cooled to exhibit a smectic C phase (Sm C*). Upon combining the cooling and application of the electric field, a FLC material exhibiting the monostable state may be obtained. In one aspect of the present invention, the injection temperature may be about 100° C. In another aspect of the present invention the first phase transformation temperature (Tni) may be about 90° C. to about 100° C. In still another aspect of the present invention, the second phase transformation temperature (Tsn) may be about 60° C. to about 80° C. The first and second transformation temperatures (Tni and Tsn, respectively) may vary according to the type of FLC material injected. In yet another aspect of the present invention, the applied electric field may be generated by applying a voltage directly to upper and lower electrodes of the LCD panel. In still another aspect of the present invention, the applied electric field may be generated by applying a direct current voltage of about ±1-9V to the LCD panel. In another aspect of the present invention, the applied electric field may have an alignment polarity pattern wherein a polarity of the electric field applied to the LCD panel may be inverted between vertical lines of liquid crystal cells within the LCD panel. In one aspect of the present invention, the direction of the spontaneous polarization of the FLC material may be substantially identical to a direction of the applied electric field. In one aspect of the present invention, the FLC material may be injected into the liquid crystal cells of the LCD panel at a temperature at which the liquid crystal material exhibits the nematic (N*) phase. In another aspect of the present invention, the FLC material may be dispensed onto one of the substrates, rather than being injected between the two substrates. Accordingly, after the FLC material is dispensed onto one of the substrates, the other of the substrates on which the FLC material is not dispensed is bonded to the substrate having the dispensed FLC material.

In accordance with the principles of the present invention, the data driving circuit 62 may invert the polarity of data voltages applied to the data lines D1 to Dm (R, G, and B) between successive frames in response to a data control signal (DDC) outputted by the timing controller 61. Further, the polarity of the data voltages applied to the consecutive ones of the data lines D1 to Dm may be inverted. Therefore, and though not shown, the data driving circuit 62 may, for example, include a shift register, a data register, a first latch, a second latch, a digital-to-analog converter (DAC), and an output circuit connected in succession between the timing controller 61 and the data lines D1 to Dm.

The shift register may generate a carry signal by shifting a source start pulse (SSP) and deliver the carry signal to a next stage shift register.

The data register may temporarily store the digital pixel data (R, G, B) outputted by the timing controller 61 and supply the stored digital pixel data (R, G, B) to the first latch.

In response to the sampling signal sequentially outputted by shift register, the first latch may latch the digital pixel data (R, G, B) outputted by the data register in correspondence with one horizontal line and may output previously latched digital pixel data in correspondence with another horizontal line.

The second latch may latch the data corresponding with the another horizontal line outputted from the first latch and output latched digital pixel data corresponding to yet another horizontal line in response to a source output enable (SOE) outputted by the timing controller 61.

The DAC may decode the digital pixel data outputted by the second latch and select a positive gamma voltage or negative gamma voltage to correspond with the digital pixel data in response to a polarity control signal (POL) outputted from timing controller 61. In one aspect of the present invention, the polarity control signal (POL) may maintain a predetermined logic value of the polarity during the entire frame period of the LCD panel such that the polarity of the applied analog data voltage is not inverted during the frame period of the LCD panel. In another aspect of the present invention, the polarity control signal (POL) may cause the polarity of the applied analog data voltage to be inverted at least once during the frame period of the LCD panel. Accordingly, the DAC may control the polarity of an analog data voltage applied to LCD panel 64.

The output circuit may be mounted between the DAC and the data lines D1 to Dm and minimize a signal attenuation of data voltages supplied to the data lines D1 to Dp, wherein p is a positive integer smaller than m.

In accordance with the principles of the present invention, the gate driving circuit 63 may sequentially apply scan pulses at least twice to each gate line G1 to Gn during a single frame period of the LCD panel 64 in response to a multiple gate start pulse (MGSP) and a gate control signal (GDC) outputted from the timing controller 61. Accordingly, the sequentially applied scan signals may successively scan the horizontal lines of liquid crystal cells included within the entire LCD at least twice. In one aspect of the present invention, the gate driving circuit 63 may, for example, include a shift register for generating scan pulses and a level shifter 92 for shifting the scan pulse voltages to the level appropriate to the drive the liquid crystal cell (CLc) in response to the multiple gate start pulse (MGSP) and the gate control signal (GDC).

The timing controller 61 may, for example, generate a data control signal (DDC), a gate control signal (GDC), and a multiple gate start pulse (MGSP) in response to a vertical synchronization signal (V), a horizontal synchronization signal (H), and a main clock (MCLK) outputted from a main driving circuit board (not shown). In one aspect of the present invention, the data control signal (DDC) may, for example, include a source start pulse (SSP), a source shift clock (SSC), a source output control signal (SOC), a polarity control signal (POL), and the like. In another aspect of the present invention, the gate control signal (GDC) may include, for example, include a gate shift clock (GSC), a gate output control signal (GOE), and the like. In still another aspect of the present invention, the timing controller 61 may sample the digital pixel data (R, G, B) inputted during a data enable period and supply the sampled digital pixel data (R, G, B) to the data driving circuit 62 in accordance with a one channel system. In yet another aspect of the present invention, the timing controller 61 may divide the digital pixel data (R, G, B), inputted during the data enable period, into even data and odd data and supply the divided digital pixel data (R, G, B) to the data driving circuit 62 in accordance with a two channel system.

The timing controller 61 may further include a memory device for storing the digital pixel data (R, G, B) during one frame period of the LCD panel. In one aspect of the present invention, the memory device may be provided as a frame memory capable of storing digital pixel data for each liquid crystal cell within the entire LCD panel for one frame period of the LCD panel. In another aspect of the present invention, the memory device may store the digital pixel data within a period of time smaller than one frame period of the LCD panel. After the digital pixel data is stored in the memory device, it may be applied to the data driving circuit 62 at least twice during one frame period of the LCD panel.

Figure 18:
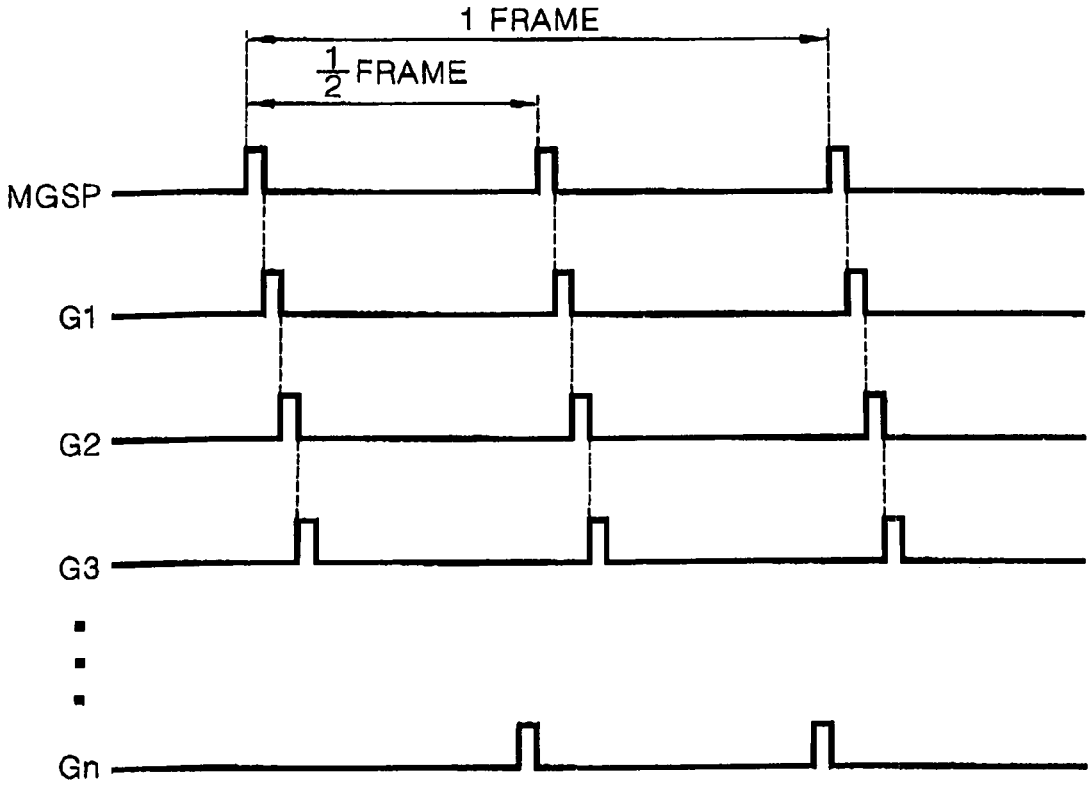
FIG. 18 illustrates a waveform diagram of a multiple gate start pulse applied to the gate driving circuit shown in FIG. 16 and scan pulses applied to gate lines of the liquid crystal display panel FIG. 16 in accordance with the multiple gate start pulse.

FIG. 18 illustrates a waveform diagram of a multiple gate start pulse applied to the gate driving circuit shown in FIG. 16 and scan pulses applied to gate lines of the liquid crystal display panel FIG. 16 in accordance with the multiple gate start pulse.

Referring to FIG. 18, the period of the multiple gate start pulse (MGSP) may be half or less than half of the frame period of the LCD panel. Accordingly, and in one aspect of the present invention, the gate driving circuit 63 may sequentially apply the scan pulses SP1 to SPn corresponding ones of the gate lines G1 to Gn, respectively, every half frame period in response to the multiple gate start pulse (MGSP), also generated every half frame period. The pulse width of the multiple gate start pulse (MGSP) and the scan pulses SP1 to SPn may be decreased proportionally (e.g., by about half) as compared with the pulse widths of scan pulses applied only once to the gate lines G1 to Gn during one frame period of the LCD panel.

Figure 19:
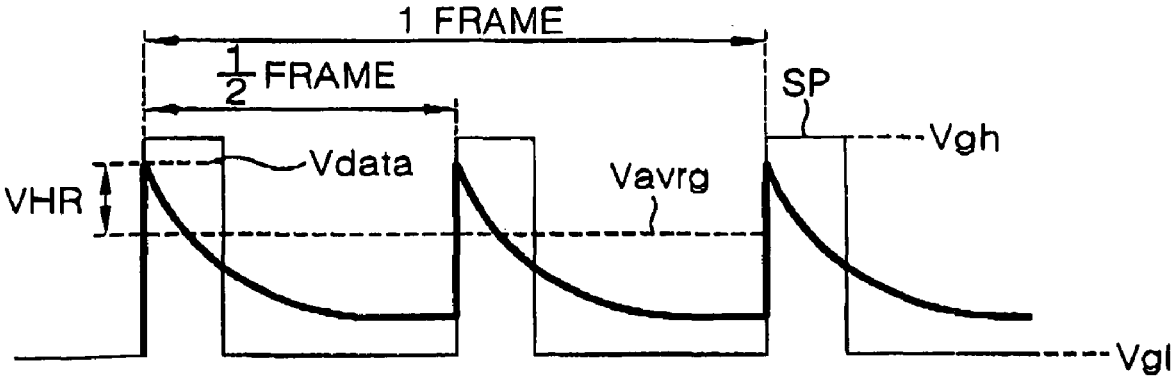
FIG. 19 illustrates a waveform diagram of a scan pulse shown in FIG. 18 and a data voltage applied to a liquid crystal cell of a liquid crystal display panel in synchrony with the scan pulse.

FIG. 19 illustrates a waveform diagram of a scan pulse shown in FIG. 18 and a data voltage applied to a liquid crystal cell of a liquid crystal display panel in synchrony with the scan pulse.

Referring to FIG. 19, data voltages charged to the FLC cells of the ferroelectric LCD in accordance with the principles of the present invention may charge data having the same gray scale value and polarity twice during one frame period of the LCD panel in response to scan pulses applied in accordance with the multiple gate start pulse (MGSP). Accordingly, the average voltage (Vavrg) charged within the FLC cell during one frame period of the LCD panel becomes substantially identical to the peak data voltage (Vdata) of the data voltage applied to the FLC cells via data lines D1 to Dn. Therefore, even though the FLC cells abruptly discharge the charged data voltages, the VHR is reduced compared to the VHR of the related art LCD. Thus, the brightness of the FLC cells increase along with the ability to control the gray scale values of the expressed images. Also shown in FIG. 19, 'Vgh' designates a high logic voltage of the scan pulse (SP) and 'Vgl' designates a low logic voltage of the scan pulse (SP).

Figure 20:
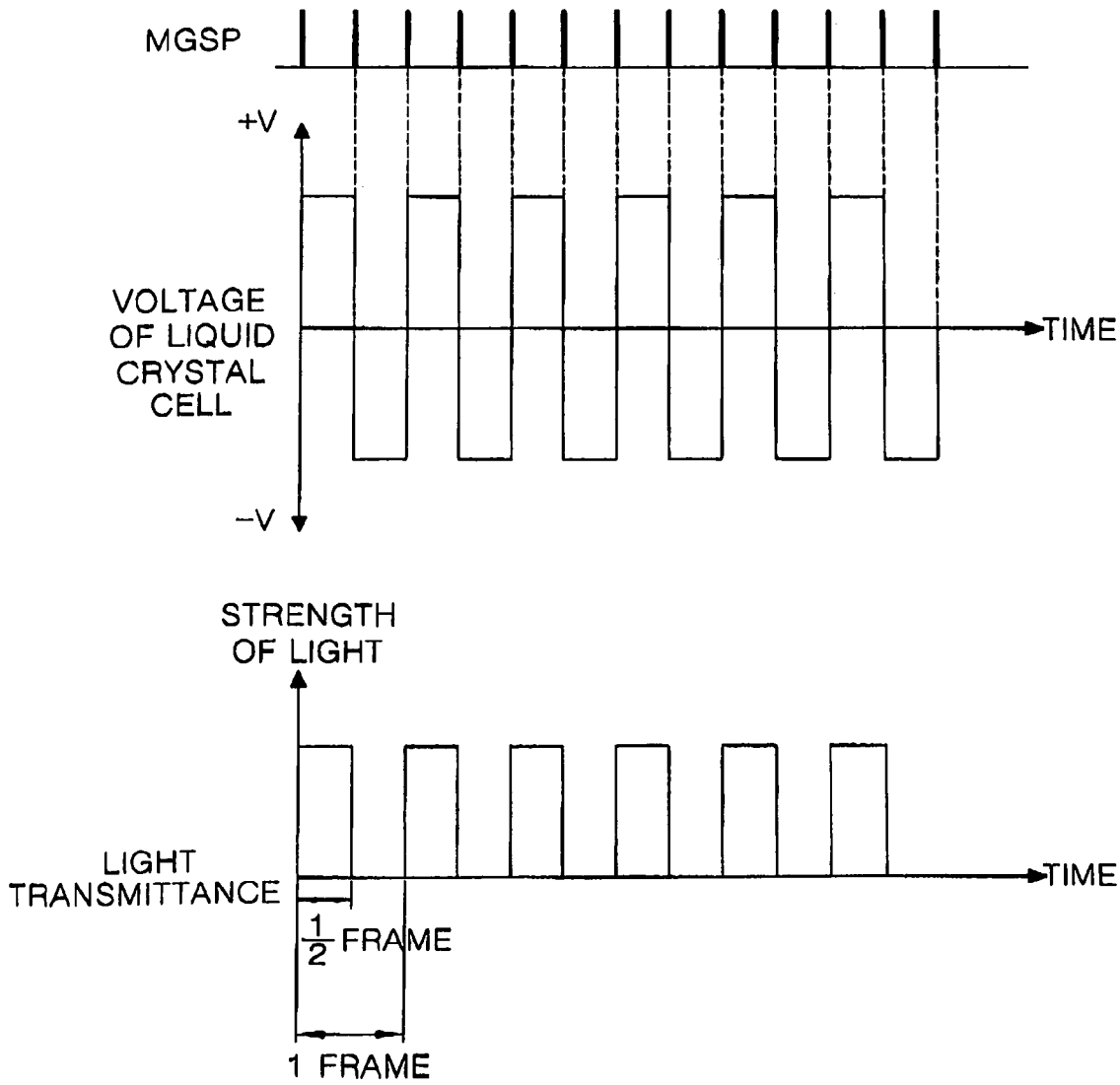
FIG. 20 illustrates a graph of a data voltage applied during driving of the liquid crystal cells shown in FIG. 17 and corresponding light transmissivity characteristics of the liquid crystal cells in accordance with the multiple gate start pulse of the present invention.

FIG. 20 illustrates a graph of a data voltage applied during driving of the liquid crystal cells shown in FIG. 17 and corresponding light transmissivity characteristics of the liquid crystal cells in accordance with the multiple gate start pulse of the present invention.

Referring to FIG. 20, the polarity of the data voltages applied to the FLC cells may be inverted every half frame period of the LCD panel. In one aspect of the present invention, the polarity of the applied data voltage may be inverted when a multiple gate start pulse is generated. Assuming the FLC cell is aligned in the presence of an applied electric field having a negative polarity, the FLC cell may transmit light in the presence of a driving data voltage having a positive polarity applied during a first half frame period of the LCD panel. Further, the FLC cell described above may transmit substantially no light in the presence of a driving data voltage having a negative polarity applied during a second half frame period of the LCD panel, substantially equal to the remainder of the frame period of the LCD panel after the first half frame period has elapsed. Accordingly, the data voltages applied to the FLC cells have the same gray scale value while the polarity of the applied data voltages is inverted. Because identical data voltages having inverted polarities are applied to FLC cells during one frame period of the LCD panel, the flicker phenomenon is substantially negligible within the LCD according to the principles of the present invention as compared to related art LCDs.

As described above, the ferroelectric LCD and the method of driving the same, in accordance with the present invention, a gate start pulse may be generated at least twice during a single frame period of the LCD panel. Further, the polarity of identical data voltages may be maintained and applied to the LCD panel at least twice during the same frame period of the LCD panel. As a result, the voltage holding ratio (VHR) may be reduced (i.e., improved) and the brightness of the LCD panel and the ability to control gray scale vales of expressed images may be increased.

Further the ferroelectric LCD and the method of driving the same may generate gate start pulses at least twice during one frame period of the LCD panel and invert the polarity of identical data voltages at least once during the same frame period of the LCD panel such that data voltages may be applied to the LCD panel at least twice during the same frame period of the LCD panel. Accordingly, the flicker phenomenon may be minimized.

It will be apparent to those skilled in the art that various modifications and variation can be made in the present invention without departing from the spirit or scope of the invention. For example, though it has been described that the gate start pulse may be generated twice during a single frame period (e.g., in accordance with half periods of the frame) by setting the width of the gate start pulse to less than half as compared with the widths of related art gate start pulses, the gate start pulse of the present invention may be generated more than twice during one frame period of the LCD panel. Further, while it has been described that the polarity of identical data voltages may be inverted once during one frame period of the LCD panel, the polarity control signal may cause the polarity of the data voltages to be inverted more than once during one frame period of the LCD panel. Further, data voltages may be applied to the liquid crystal display panel more than twice during the same frame. Thus, it is intended that the present invention cover the modifications and variations of this invention provided they come within the scope of the appended claims and their equivalents.

What is claimed is:

1. A ferroelectric liquid crystal display, comprising:

a liquid crystal display (LCD) panel including a plurality of gate lines, a plurality of data lines crossing the plurality of gate lines, and ferroelectric liquid crystal (FLC) material, wherein a plurality of liquid crystal cells arranged in a matrix pattern are defined by the crossings of the gate an data lines;

a plurality of thin film transistors connected to the gate and data lines, wherein each liquid crystal cell has a thin film transistor;

a gate driving circuit for applying substantially identical first and second scan pulses to each one of the plurality of gate lines during one frame period of the LCD panel; and a data driving circuit for applying first and second data voltages having the same gray scale value to the data lines of the LCD panel in synchrony with the first and second scan pulses during the one frame period of the LCD panel, wherein the first and second scan pulses are applied at an interval in time each other during the one frame period of the LCD panel; and wherein the first and second data voltages are applied at an interval in time each other during the one frame period of the LCD panel.

2. The ferroelectric liquid crystal display according to claim 1, wherein the Liquid crystal cell is a Half V-Switching Mode LFC cell.

3. The ferroelectric liquid crystal display according to claim 1, further comprising a timing controller for controlling the data driving circuit and the gate driving circuit.

4. The ferroelectric liquid crystal display according to claim 1, wherein the timing controller generates a multiple gate start pulse for causing the gate driving circuit to sequentially generate the first and second scan pulses and for supplying the multiple gate start pulse to the gate driving circuit.

5. The ferroelectric liquid crystal display according to claim 1, wherein the multiple gate start pulse is generated at least twice during the one frame period of the LCD panel.

6. The ferroelectric liquid crystal display according to claim 1, wherein the data driving circuit applies identical first and second data voltages to the plurality of data lines during the one frame period of the LCD panel.

7. The ferroelectric liquid crystal display according to claim 6, wherein the data driving circuit maintains polarities of the first and second data voltages applied to the data lines during the one frame period of the LCD panel.

8. The ferroelectric liquid crystal display according to claim 6, wherein the data driving circuit inverts polarities of the first and second data voltages applied to the data lines at least once during the one frame period of the LCD panel.

9. The ferroelectric liquid crystal display according to claim 3, wherein the timing controller includes a memory device for storing data such that substantially identical first and second data voltages are suppliable to the LCD panel at least twice during the one frame period of the LCD panel.

10. A driving method of a ferroelectric liquid crystal display, comprising:

providing a liquid crystal display (LCD) panel including a plurality of gate lines, a plurality of data lines crossing the plurality of gate lines, and ferroelectric liquid crystal (FLC) material, wherein a plurality of liquid crystal cells arranged in a matrix pattern are defined by the crossings of the gate an data lines;

applying first and second scan pulses to each of the plurality of gate lines during one frame period of the LCD panel; and applying first and second data voltages having the same gray scale value to the plurality of data lines in synchrony with the first and second scan pulses during one frame period of the LCD panel, wherein the first and second scan pulses are applied at an interval in time each other during the one frame period of the LCD panel; and wherein the first and second data voltages are applied at an interval in time each other during the one frame period of the LCD panel.

11. The driving method of the ferroelectric liquid crystal display according to claim 10, wherein the liquid crystal cell is a Half V-Switching Mode FLC cell.

12. The driving method of the ferroelectric liquid crystal display according to claim 10, further comprising generating a multiple gate start pulse for controlling the first and second scan pulses, wherein the multiple gate start pulse is generated at least twice during the one frame period of the LCD panel.

13. The driving method of the ferroelectric liquid crystal display according to claim 10, wherein the first and second data voltages applied to the LCD panel within the one frame period of the LCD panel is identically applied.

14. The driving method of the ferroelectric liquid crystal display according to claim 13, wherein polarities of the first and second data voltages applied to the LCD panel during the one frame period of the LCD panel is maintained.

15. The driving method of the ferroelectric liquid crystal display according to claim 13, wherein polarities of the data voltage applied to the LCD panel during the one frame period of the LCD panel is inverted at least once.

* * * * *